US005664713A

United States Patent [19]

Burgstahler

[11] Patent Number: 5,664,713

[45] Date of Patent: Sep. 9, 1997

[54] CRUTCH HOLDER

[76] Inventor: Karl F. Burgstahler, 1817 Lynwood Ct., Decatur, Ill. 62521

[21] Appl. No.: 664,473

[22] Filed: Jun. 17, 1996

[51] Int. Cl.[6] ..... A45F 3/14; A61H 3/02

[52] U.S. Cl. ..... 224/250; 224/660; 224/901.4; 135/66

[58] Field of Search ..... 224/250, 901.4, 224/638, 407, 660; 135/68, 66, 71

[56] References Cited

U.S. PATENT DOCUMENTS

| | | | |
|---|---|---|---|
| 1,769,167 | 7/1930 | Scheihing . | |
| 2,473,671 | 6/1949 | Yackley | 135/49 |
| 5,165,436 | 11/1992 | Hall, Sr. et al. | 135/66 |
| 5,325,959 | 7/1994 | Goldberger | 224/901.4 |
| 5,348,035 | 9/1994 | Porter | 135/68 |
| 5,410,762 | 5/1995 | Maskovich | 224/250 |

FOREIGN PATENT DOCUMENTS

| | | | |
|---|---|---|---|
| 4102498 | 7/1992 | Germany | 135/68 |
| 1717135 | 3/1992 | U.S.S.R. | 135/68 |
| 2280096 | 1/1995 | United Kingdom | 224/250 |

*Primary Examiner*—Linda J. Sholl
*Attorney, Agent, or Firm*—Don Moyer

[57] ABSTRACT

An elastic band which can be removably attached around a person has two straps attached which am located at the person's sides so that the upper portions of under-arm crutches can be secured by the straps to hold the crutches from falling away while allowing free movement of the person's arms and torso.

1 Claim, 1 Drawing Sheet

FIG. 1
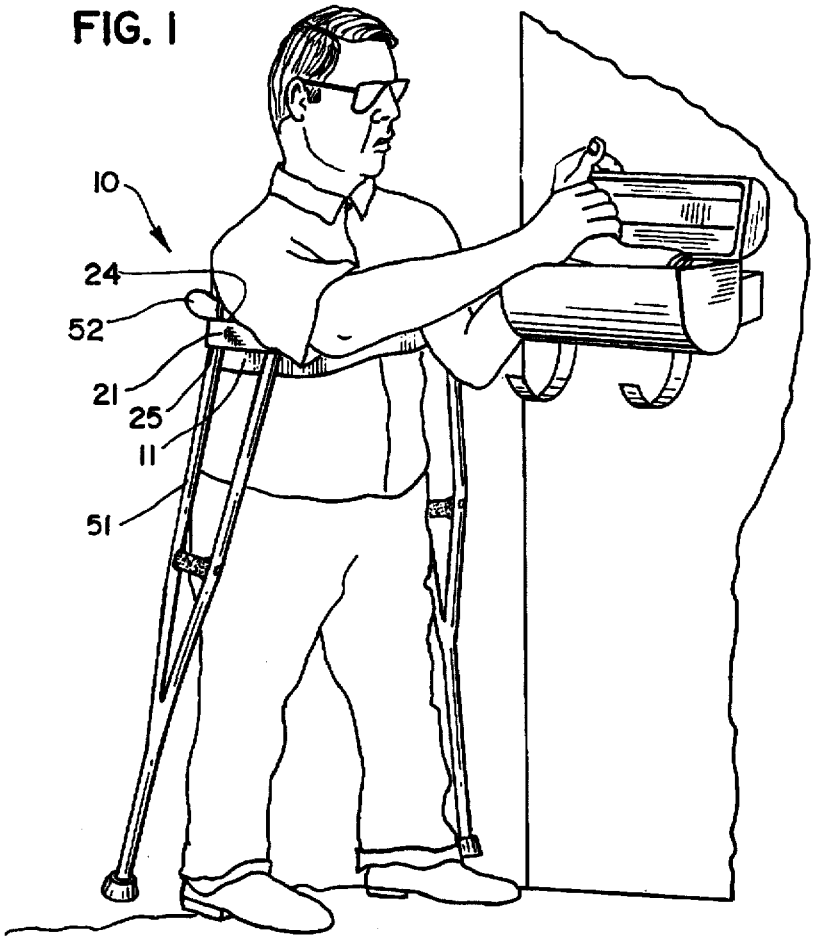
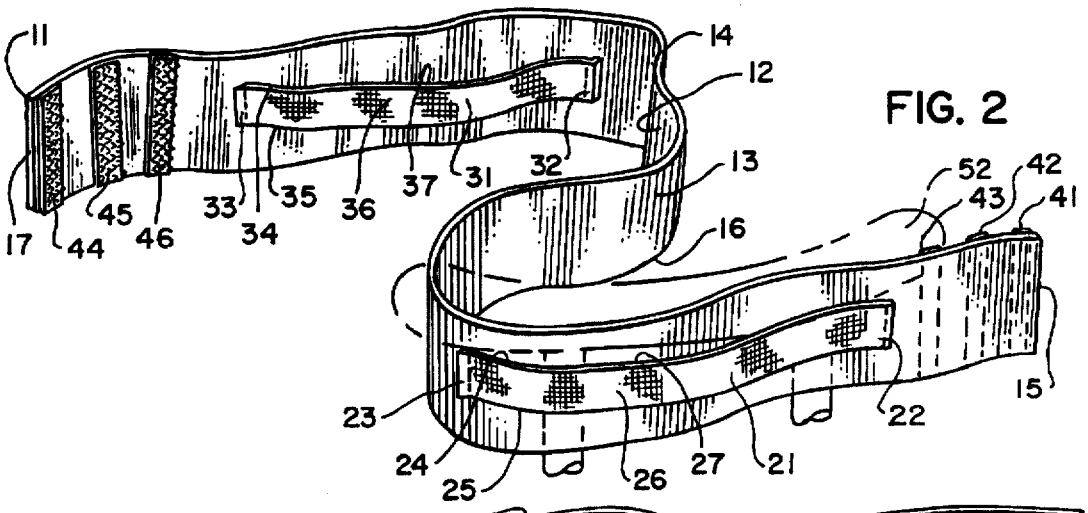
FIG. 2
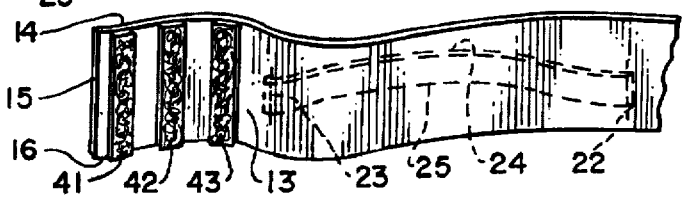
FIG. 3

CRUTCH HOLDER

BACKGROUND OF THE INVENTION

This invention can hold a crotch from falling away from under a person's arm while allowing free movement of the person's arm.

People who use under-arm crutches have a problem when they need to reach out with an arm so that then a crutch is not supported and can easily fall away from the person. For example, a student who is using under-arm crutches and who is working at a class-room blackboard can easily have a crutch drop away so that awkward maneuvering is needed to retrieve the crutch.

An over-shoulder, around-turn harness shown by Hall in U.S. Pat. No. 5,165,436, over-shoulder straps and locking devices shown by Yackley in U.S. Pat. No. 2,473,671, and around-leg and around-torso straps shown by Scheihing in U.S. Pat. No. 1,769,167 all involve specially constructed crutches with mechanisms having many parts and still to not allow free movement of the arms and torso while holding the crutches from failing away.

Thus, there is an opportunity for a product which will hold crotches from falling away while allowing free movement of arms and torso.

SUMMARY OF THE INVENTION

Objects of this invention include the following. Make a crutch holder which is separate from crutches and which will work with any under-arm crutches. Make a crutch holder which can be easily and removably attached under a person's arm. Make a crotch-holder to which any under-arm crutches can be secured easily and removably. Make a crutch holder which will reliably hold crutches from falling away while allowing free movement of arms and torso. Make a crutch holder which is easy to manufacture and which has low cost.

In Summary, one embodiment of this invention is an elastic band which can be removably attached around a person under the person's arms, the band having two elastic straps fastened to the band so that the elastic straps are located at the person's sides when the band is attached under the person's arms, and so that the straps can secure the upper portions of crutches to hold the crutches from falling away while allowing free movement of the person's arms and torso.

Other equivalent embodiments will be comprehended in the detailed description of the drawings, which will make additional equivalent embodiments obvious to people skilled in the art.

DRAWING FIGURES

FIG. 1 shows the new crutch holder in use.

FIG. 2 shows the crutch holder not in use.

FIG. 3 shows a portion of the back surface of the crutch holder.

DETAILED DESCRIPTION OF THE DRAWINGS

The new crutch holder 10 is shown in use in FIG. 1, and the parts of the holder are shown in FIG. 2 and FIG. 3. A band 11 has a front surface 12 and a back surface 13. In use the back surface is worn toward the persons body. The band has a first long edge 14, a first short edge 15 generally perpendicular to the first long edge, a second long edge 16 generally parallel to the first long edge, and a second short edge 17 generally parallel to the first short edge. In the preferred embodiment the band is elastic, the long edges are forty-four inches long, and the short edges are three inches long. The holder can be made in various lengths to suit different size people, and the shape of the holder can be varied to suit various conditions and decorative needs.

Two strops, a first strap 21 and a second strap 31, are fastened to the band. Each strap has a first fastening end 22 and 32 and has a second fastening end 23 and 33 where the straps can be fastened to the band. Each strap has a first long edge 24 and 34 and has a second long edge 25 and 35, with the first and second long edges being generally parallel. Each strap has a front side 26 and 36, and each strap has a back side 27 and 37.

In the preferred embodiment each of the straps is elastic, is thirteen inches long, is one and one half inches wide, and is sewn to the band so that the strap long edges are generally parallel to the band long edges with the strap located generally midway between the band long edges. The snaps can be made of different sizes to suit different size people and can be fastened to the band by various means in different orientations to suit different conditions.

Near the band first short edge 15 three generally identical hook-and-loop fastener ships 41, 42, and 43 are attached generally parallel to the band short edge. Three complementary hook-and-loop fastener snips 44, 45, and 46 are attached near to and parallel to the band second short edge 17. In use the band is worn around the person under the person's arms with the band short edges overlapped and appropriate hook-and-loop fastener pairs engaged. By choosing different pairings—from 41 engaged with 44 to 43 engaged with 46—there can be a six inch variation in the circumference of the band around the person.

In the preferred embodiment the straps are attached to the band so that they are under the person's arms when the band is worn around the person with the hook-and-loop fastener strips located on the person's front side. The band can also be worn with the fastener strips located on the persons back side if that positions the straps more appropriately. Holders can be made with different placements of the straps to suit different size people. The band first long edge can be worn above the band second long edge as shown and described here, and alternatively the band second long edge can be worn above the band first long edge.

The upper portion 52 of an under-turn crotch 51 can be inserted easily between the first strap back 27 and the band front surface 12 to protrude above the first band first long edge 24. A second crutch upper portion (not shown) can also be inserted easily between the second strap back 37 and the band front surface 12 to protrude above the second band first long edge 34. Because the snaps are elastic and curve around the person's sides the crutch upper portions are secured in place above the straps and the crutches are held from falling away while allowing flee movement of the person's arms and torso.

The straps can be replaced by other equivalent means for securing a crutch from falling away from under a person's arm while allowing free movement of the person's arm. Similarly the band can be replaced by other equivalent means for holding the straps, or for holding means equivalent to the straps, under the person's arm.

Other equivalent forms for the crutch holder, other equivalent means for securing a crutch with a strap and other equivalent means for holding the snap under a persons arm with a band will be obvious to people skilled in the art. It is understood therefore that this invention is not limited to the particular examples illustrated here.

I claim:

1. In combination with a crutch, the crutch having an upper portion with a width, a position of use for the crutch upper portion being at the underside of an arm-body joint of a person, the crutch and a crutch holder comprising:

a band, the band being elastic, the band having a first long edge and a second long edge, the band having means for removably attaching the band around the person's torso with the first long edge at the position of use for the crutch upper portion; and a strap, the strap being elastic and having an unstretched length less than the width of the upper portion of the crutch, the strap having a first fastening end and a second fastening end, the first fastening end being fixedly attached to the band between the band first long edge and the band second long edge, the second fastening end being fixedly fastened to the band between the band first long edge and the band second long edge and spaced from the first fastening end a distance equal to the unstretched length, the crutch being positioned between the band and the strap with the upper portion of the crutch positioned above the strap and the rest Of the crutch positioned below the strap so that the crutch will not fall away from the position of use for the crutch upper portion.

* * * * *